US005765387A

United States Patent [19]

Amin

[11] Patent Number: 5,765,387

[45] Date of Patent: Jun. 16, 1998

[54] DEVICE AND METHOD FOR THERMAL TRANSFER USING AIR AS THE WORKING MEDIUM

[75] Inventor: Sanjaykumar Amin, Youngstown, Ohio

[73] Assignee: Entropy Systems, Inc., Youngstown, Ohio

[21] Appl. No.: 596,546

[22] Filed: Feb. 5, 1996

Related U.S. Application Data

[63] Continuation of Ser. No. 391,108, Feb. 21, 1995, Pat. No. 5,547,341, which is a continuation-in-part of Ser. No. 171, 516, Dec. 22, 1993, abandoned.

[51] Int. Cl.[6] ..... F25D 9/00

[52] U.S. Cl. ..... 62/401

[58] Field of Search ..... 62/401

[56] References Cited

U.S. PATENT DOCUMENTS

| | | | |
|---|---|---|---|
| 966,428 | 8/1910 | Comstock | 415/143 |
| 2,570,081 | 10/1951 | Szczeniowski | 415/199.6 |
| 3,761,195 | 9/1973 | Eskeli | 415/80 |
| 3,791,167 | 2/1974 | Eskeli | 62/401 |
| 3,828,573 | 8/1974 | Eskeli | 62/401 |
| 3,834,179 | 9/1974 | Eskeli | 62/401 |
| 3,926,010 | 12/1975 | Eskeli | 62/401 |
| 3,938,336 | 2/1976 | Eskeli | 62/401 |
| 4,003,673 | 1/1977 | Eskeli | 415/80 |
| 4,012,164 | 3/1977 | Eskeli | 415/80 |
| 4,030,856 | 6/1977 | Eskeli | 415/80 |
| 4,068,975 | 1/1978 | Eskeli | 415/80 |
| 5,117,655 | 6/1992 | Anderson | 62/401 |

OTHER PUBLICATIONS

"Physics", Resnick et al, pp. 638–639.

*Primary Examiner*—John T. Kwon

*Attorney, Agent, or Firm*—Fay, Sharpe, Beall, Fagan, Minnich & Mckee

[57] ABSTRACT

A method is disclosed for generating a thermal difference in a working medium between an inlet and an outlet of an enclosure and transferring the thermal difference to a region being cooled. The working medium is drawn into the enclosure (45) through the inlet (76). A force is applied to compress the working medium in the enclosure with decreasing entropy in the working medium and with an input of work to the working medium. The working medium is allowed to expand through the outlet (56) with a change in entropy between zero and no greater than the magnitude of the decrease in entropy during the step of compression and with an output of work from the working medium equal to or greater than the work input to the working medium in the step of compression. Thereby, a thermal difference is caused in the working medium between the inlet and the outlet. The thermal difference is transferred to the region being cooled. An advantage of the method is a more efficient means of generating a thermal difference in a working medium.

11 Claims, 5 Drawing Sheets

DEVICE AND METHOD FOR THERMAL TRANSFER USING AIR AS THE WORKING MEDIUM

CROSS REFERENCE TO RELATED APPLICATION

This application is a continuation of "Device for Thermal Transfer Using Air as the Working Medium", Ser. No. 08/391,108, filed Feb. 21, 1995, now U.S. Pat. No. 5,547,341, which is a continuation in part of Ser. No. 08/171,516, filed Dec. 22, 1993, now abandoned.

FIELD OF THE INVENTION

The present invention relates in general to devices for thermal transfer. More particularly, the present invention pertains to devices for heating and cooling employing air as the working medium.

BACKGROUND OF THE INVENTION

The availability of heating and cooling is fundamental to survival and comfort. Thermal transfer devices, including heat pumps and air conditioners, introduce power from an external source to supply or remove heat as desired, and nearly invariably employ a transfer medium to effect this exchange. The transfer medium (also called the working medium or fluid, and often referred to as a refrigerant) that has been found historically to be most cost effective during the ordinary vapor compression refrigeration cycle is that of a group of halogenated hydrocarbons containing one or more fluorine atoms, available under the trademark FREON. In recent years at least such compositions that are chlorinated have been linked to the destruction of the Earth's protective ozone layer, and have been identified as one of humankind's most serious and urgent environmental problems. Consequently, countries throughout the world have mandated that the use of such compositions be significantly reduced and, by the beginning of the next century, eliminated.

Existing heat transfer devices are subject to a variety of other shortcomings. Commonly such devices are closed systems that employ reciprocating or displacement type engines, which have relatively low efficiencies and a large number of parts. For example, vapor compression refrigeration cycle-based systems require one or more refrigeration coils, compressors, condensers and expansion valves or other throttling equipment. The number, configuration and complexity of parts and their relative motions result in devices that are expensive to manufacture, are subject to significant wear and require appreciable maintenance. Their size and weight make them undesirable for applications where compactness, low weight and higher efficiency are more critical, such as on aircraft and other vehicles.

SUMMARY OF THE INVENTION

It is, therefore, an object of the present invention to provide a device for heat transfer that uses a working medium other than FREON.

It is another object of the present invention to provide an open system heat transfer device, as set forth above, that uses air as its working medium.

It is still another object of the present invention to provide a heat transfer device, as set forth above, that does not use reciprocating or displacement type engines.

It is yet another object of the present invention to provide a device, as set forth above, that has higher efficiencies and fewer parts than vapor compression refrigeration cycle-based systems, and does not require refrigeration coils, compressors, condensers and expansion valves or other throttling equipment.

It is a further object of the present invention to provide a device, as set forth above, that is less expensive to manufacture, subject to less significant wear and requires less maintenance than vapor compression refrigeration cycle-based systems.

It is still a further object of the present invention to provide a device, as set forth above, whose compactness and low weight make it desirable for applications, such as on aircraft and other vehicles.

These and other objects and advantages of the present invention over existing prior art forms will become more apparent and fully understood from the following detailed description in conjunction with the accompanying drawings.

In general, in accordance with the present invention, a device for generating a thermal difference in a working medium includes a housing, an impeller assembly, a substantially annulus-shaped disk having a plurality of outlet vanes along the perimeter thereof, and a substantially circular disk having a plurality of inlet vanes along the perimeter thereof. The impeller assembly includes a plurality of blades extending from a central hub to a casing, defining a like plurality of compartments within the impeller assembly, and is carried coaxially substantially within the housing. The outlet vanes are shaped to allow the annulus-shaped disk to be carried coaxially substantially within the impeller assembly, and the diameter of the inlet vanes allow the substantially circular disk to be carried coaxially substantially within the interior of the annulus-shaped disk.

In general, in accordance with the present invention, a method for generating a thermal difference in a working medium in an enclosure having an inlet and an outlet, includes the steps of applying a force to compress the working medium with decreasing entropy, allowing the working medium to expand with a change in entropy between zero and no greater than the magnitude of the decrease in entropy during the step of compression, whereby a thermal difference will arise in the working medium between the inlet and the outlet, and transferring the thermal difference to a region being cooled.

DETAILED DESCRIPTION OF THE INVENTION

Figure 1:
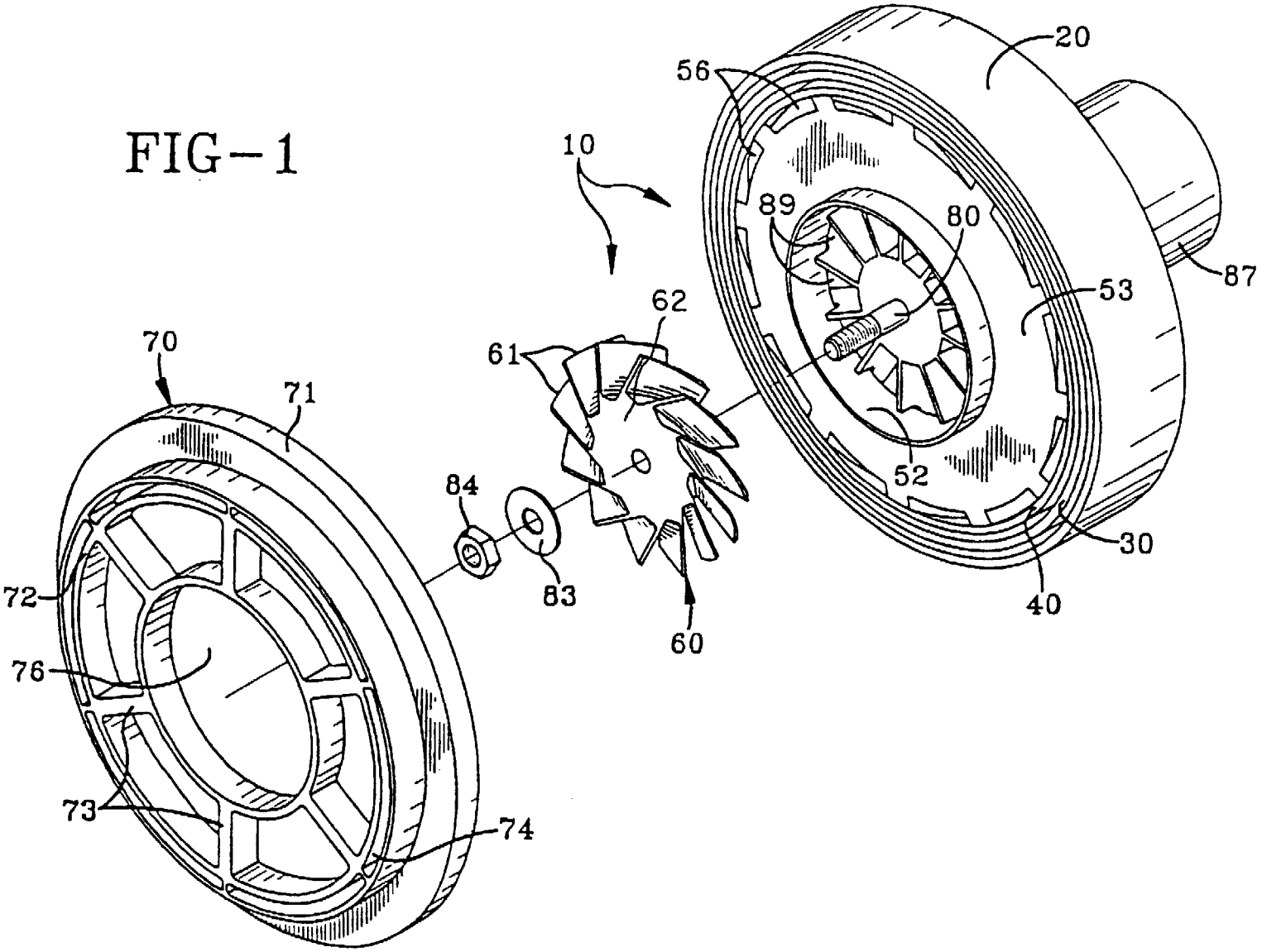
FIG. 1 is a partially exploded, perspective view of an exemplary device in accordance with the present invention, in which the device is substantially cylindrical and depicting in exploded form the inlet vane disk and shroud.

FIG. 1 presents in partial exploded perspective an exemplary device in accordance with the present invention, generally indicated by the numeral 10, for heat transfer using air as the working medium. In order to more fully appreciate the construction and operation of device 10, it is helpful to first set forth certain underlying principles upon which the construction and operation is believed to be founded.

All matter and energy have some form of disordered energy inherent in them, and this disordered energy is the energy of the units of the working medium (that is, the matter or energy) which have their energies divided among various energy levels. The method of the present invention adds or subtracts potential energy to a particular group of units of the working medium or their energy levels. This may be accomplished by introducing the working medium into a potential energy field whose effective dimensions are less than the dimensions encompassed by the working medium.

The potential energy fields in which the working medium may be introduced include any acceleration force field such as a gravitational field, a centrifugal field, a centripetal field, a linear acceleration field, an electromagnetic field, an electric field, a magnetic field and a nuclear field. If the working medium has a component of displacement aligned with the direction of the potential energy field, the kinetic energy of the working medium is altered. If a component of the displacement is in the direction of increasing kinetic energy, then potential energy is decreased; if a component of displacement is in the direction of decreasing kinetic energy, then potential energy is increased; and, if the component of displacement in both directions are equal, then the average total energy of the working medium remains constant. Inasmuch as the working medium is made up of units whose energies are distributed in various energy levels, the same effect on kinetic energy occurs for both the units and their energy levels. Thus, the addition and subtraction of potential energy may be achieved by controlling a component of the displacement of the working medium or its energy levels.

By Einstein's principle of equivalence, acceleration is equivalent to gravitation. A gravitational field acts in one dimension toward the source of the field. Therefore, if the working medium is introduced into a gravitational field with at least one, but not all of its dimensions aligned with the direction of the force field, the energy of the units having a component of displacement aligned with the direction of the force field will differ from the energy of the units whose component of displacement is in other dimensions.

By conventional processes, the addition of energy to the working medium also divides the energy randomly among all the units and their energy levels. But in the method of the present invention energy is added only to a select number of units and energy levels. This decreases the randomness in the distribution of energy among the units of the working medium and results in an ordering of the distribution of energy. Entropy is a variable universally used in defining the thermodynamic state of matter by relating its energy to absolute temperature and to its state of order (more particularly, the probability of a given distribution of momentum among its units). Thus, an ordering of the distribution of energy is also commonly referred to as a decrease in entropy. I have appreciated that the selective variation in the entropy of a system of matter or energy (in other words, the selective introduction of order in a portion of a disordered system) may be used to transfer heat efficiently and without the use of fluorinated hydrocarbons working mediums.

There are a variety of mechanisms to effect such selective introduction of order in a disordered system. For example, the working medium may be introduced into a gravitational field with at least one dimension aligned with the direction of the gravitational force; rotated with at least one dimension aligned with the radius of rotation; accelerated (at a positive, negative or constant rate) with at least one dimension aligned with the direction of acceleration; or, introduced into an electromagnetic, electric, magnetic, or nuclear force field with at least one dimension aligned with the direction of the force field.

Device 10, a control volume, uses air as its working medium and applies a centrifugal force along the radius of rotation. This increases the kinetic energy of, and compresses the working medium, raising its temperature, pressure and density. The entropy of the enclosed air is reduced during this compression step because the entropy transfer accompanying heat transfer from the air to the surroundings is greater than the entropy produced as a result of irreversibilities.

Figure 2:
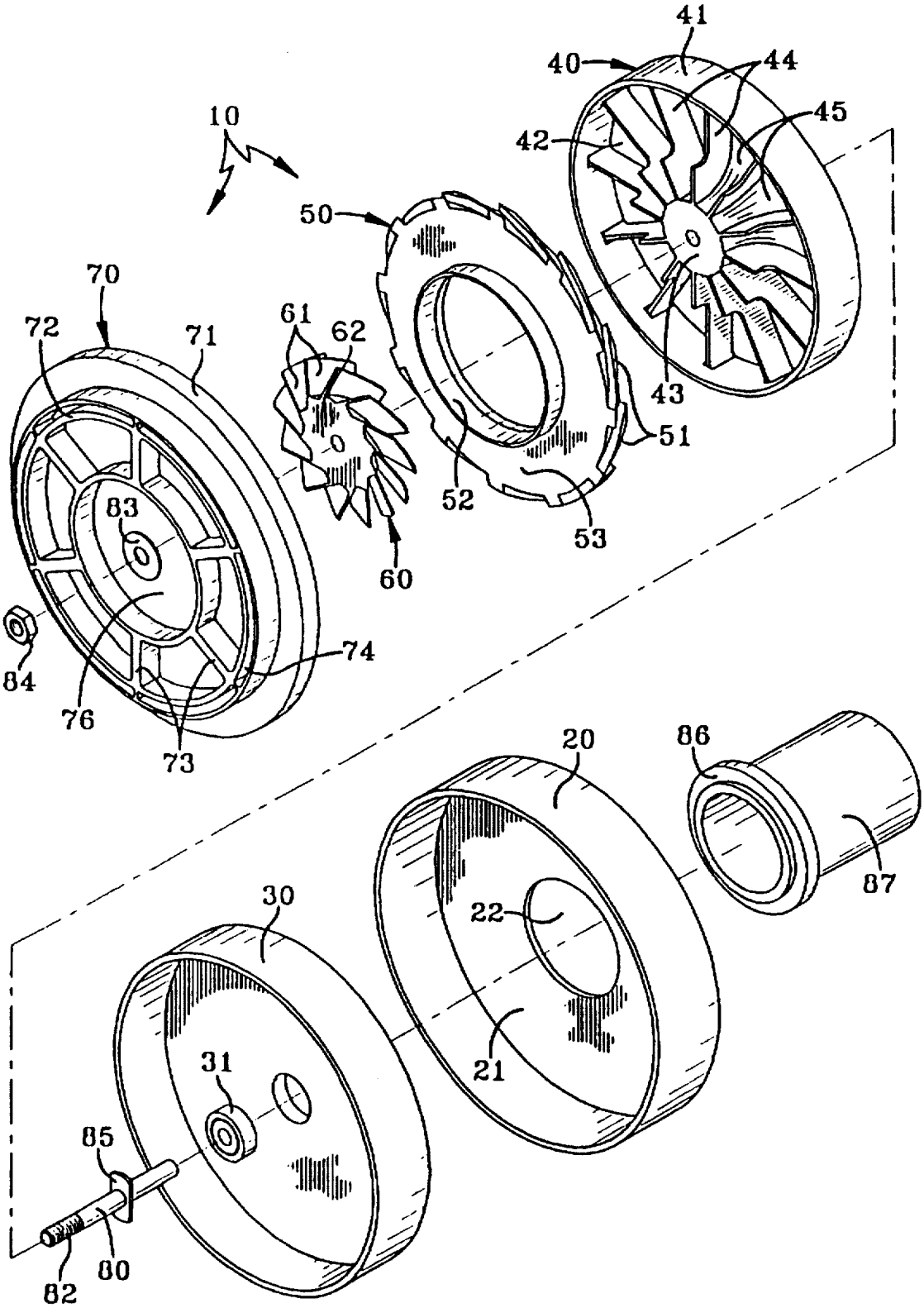
FIG. 2 is an exploded, perspective view of the device shown in FIG. 1.
Figure 3:
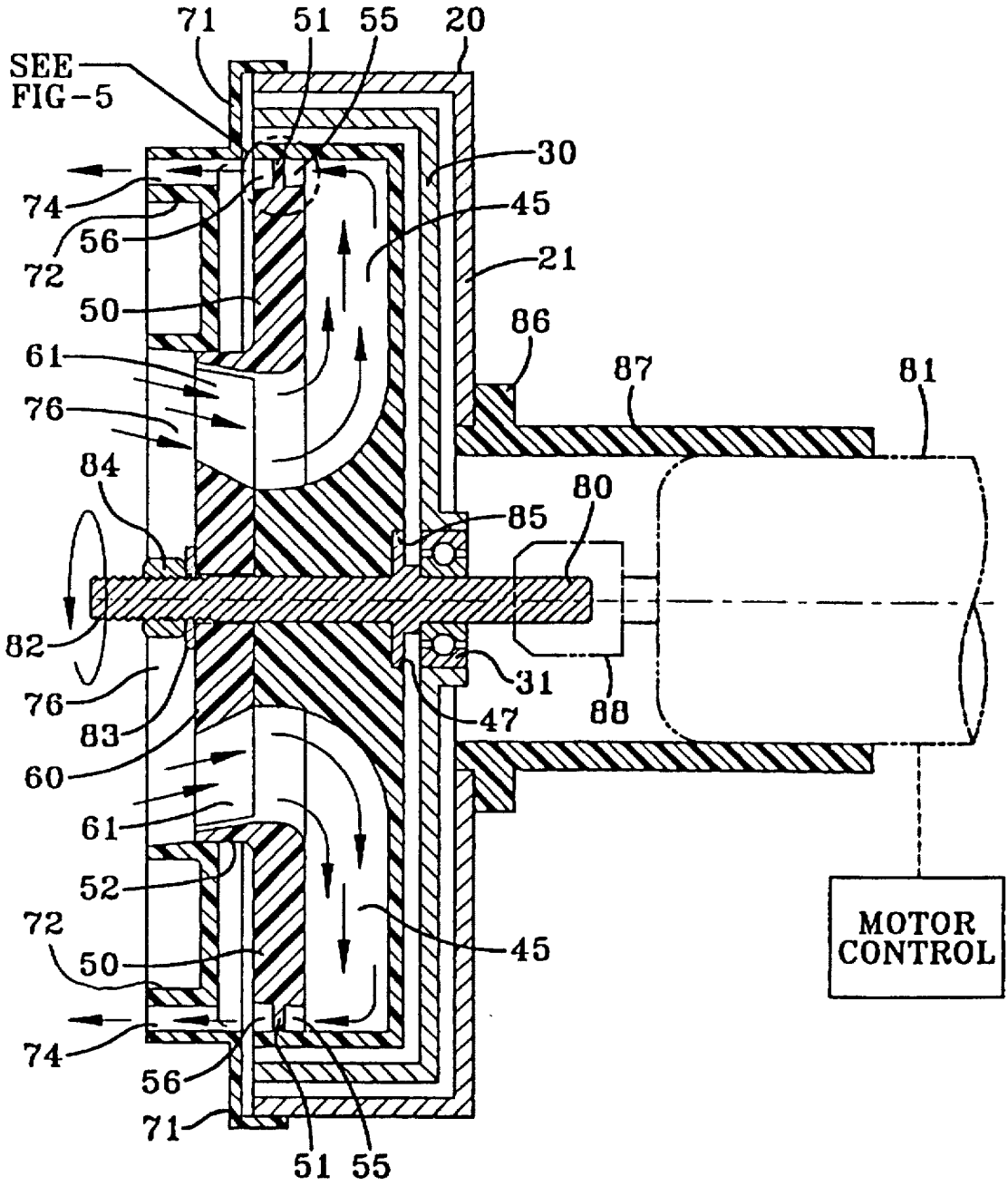
FIG. 3 is a section of the device shown in FIG. 1 taken through any diameter thereof along the longitudinal axis of its shaft.
Figure 6:
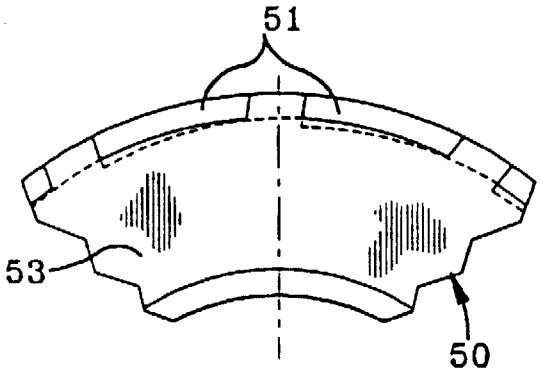
FIG. 6 is a right side magnified view of a portion of a first configuration of outlet vanes illustrated in the inset shown in FIG. 3 in which the vane thickness is substantially constant but the vane root diameters vary from smallest at their inlet to largest at their outlet.
Figure 5:
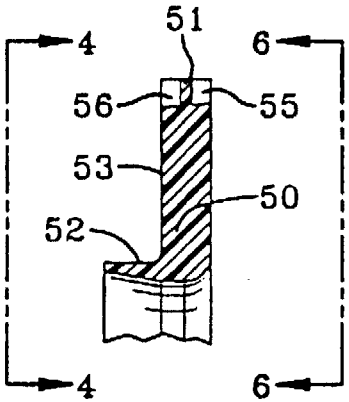
FIG. 5 is a magnified view of a first configuration of outlet vanes illustrated in the inset shown in FIG. 3 in which the vane thickness is substantially constant but the vane root diameters vary from smallest at their inlet to largest at their outlet.
Figure 7:
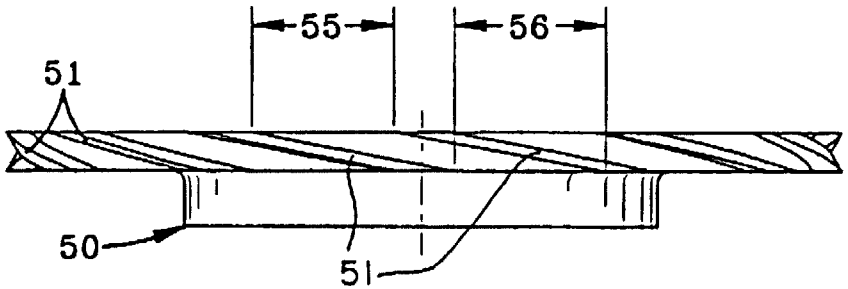
FIG. 7 is a top, magnified view of a portion of a first configuration of outlet vanes illustrated in the inset shown in FIG. 3 in which the vane thickness is substantially constant but the vane root diameters vary from smallest at their inlet to largest at their outlet.
Figure 4:
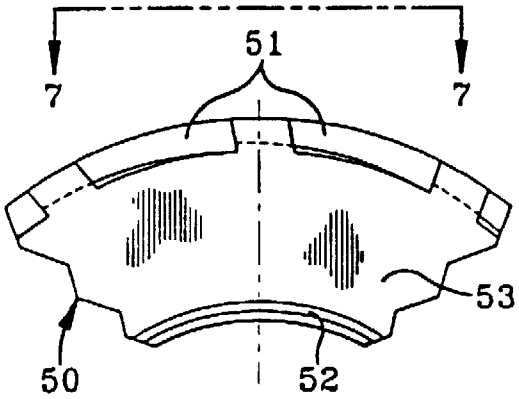
FIG. 4 is a left side magnified view of a portion of a first configuration of outlet vanes illustrated in the inset shown in FIG. 3 in which the vane thickness is substantially constant but the vane root diameters vary from smallest at their inlet to largest at their outlet.
Figure 10:
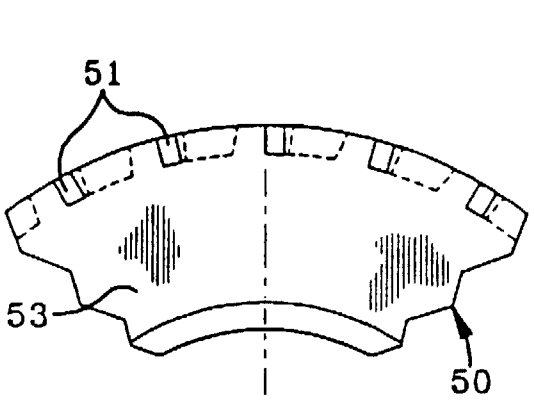
FIG. 10 is a right side magnified view of a portion of a second configuration of outlet vanes illustrated in the inset shown in FIG. 3 in which the vane root diameters remain substantially constant but the vane thicknesses vary from smallest at their inlet to largest at their outlet.
Figure 9:
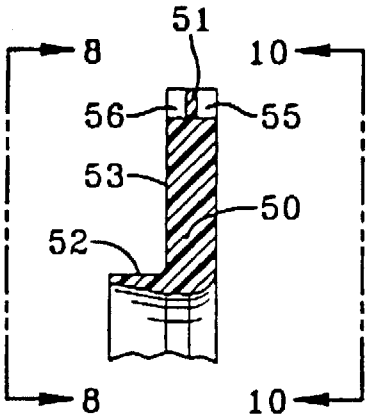
FIG. 9 is a magnified view of a second configuration of outlet vanes illustrated in the inset shown in FIG. 3 in which the vane root diameters remain substantially constant but the vane thicknesses vary from smallest at their inlet to largest at their outlet.
Figure 8:
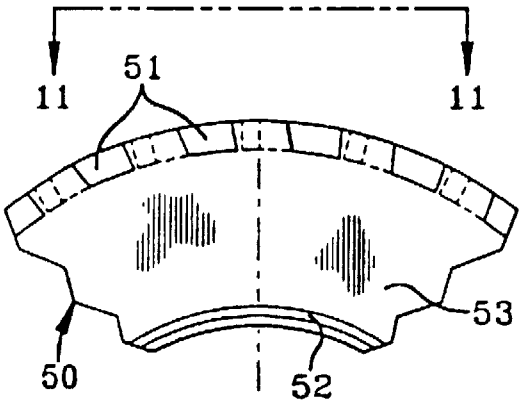
FIG. 8 is left side magnified view of a portion of a second configuration of outlet vanes illustrated in the inset shown in FIG. 3 in which the vane root diameters remain substantially constant but the vane thicknesses vary from smallest at their inlet to largest at their outlet.
Figure 11:
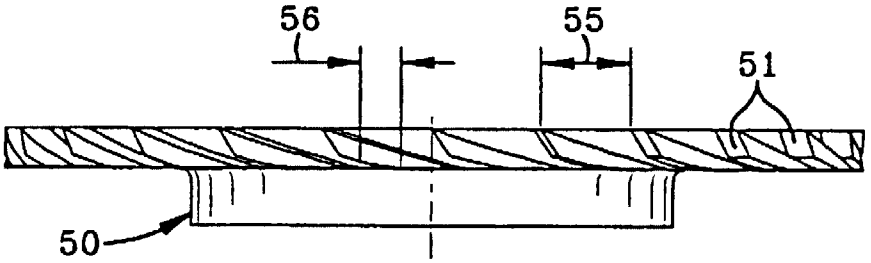
FIG. 11 is a top, magnified view of a portion of a second configuration of outlet vanes illustrated in the inset shown in FIG. 3 in which the vane root diameters remain substantially constant but the vane thicknesses vary from smallest at their inlet to largest at their outlet.

Device 10 may be seen in the exploded, perspective view of FIG. 2, the partially exploded, perspective view of FIG. 1, and the sectional view of FIG. 3, to include a housing 20, drag rotor 30, impeller 40, outlet vanes annulus 50, inlet vanes disk 60 and shroud 70, all coaxially carried about a drive shaft 80 from motor 81 having a threaded end 82 for receiving washer 83 and retaining nut 84. The rotational force output from motor 81 may be coupled to drive shaft 80 by any suitable means including collet 88 (as shown in FIG. 3).

Housing 20 may be made of aluminum or other lightweight, strong, heat conductive material, and is substantially cylindrical having a open front end and a closed rear plate 21 with a circular aperture 22 in the center thereof to receive the flanged end 86 of cylindrical bridge 87 to motor 81.

One or more substantially cylindrical drag rotors 30 of progressively smaller diameters, each of which drag rotors 30 has its own bearing 31 to carry its respective drag rotor 30 upon drive shaft 80, may be mounted coaxially within housing 20. Drag rotors 30 rotate in the same direction with and at a reduced rotational velocity from that of impeller 40, thereby reducing energy losses due to drag.

Impeller 40 is made of Delrin or other lightweight, strong, heat insulative material, and is substantially cylindrical having a casing 41, a closed rear plate 42 and a central hub 43 through which drive shaft 80 passes. A plurality of radial blades 44 extend from central hub 43 to the inside of impeller 40, defining a plurality (in this exemplary embodiment, twelve) of radial compartments 45 through which the working medium (air) passes. Radial blades 44 extend axially from central hub 43 at a height (dimension from front to back of impeller) of substantially the height of cylindrical impeller 40 itself. At a radial distance that substantially equals the inner diameter of the annulus of outlet vanes annulus 50, the height of blades 44 is reduced to receive outlet vanes annulus 50 as noted hereinbelow. Impeller 40 rotates with drive shaft 80 by forming in the back of rear plate 42 an engagement recess 47 (as shown in FIG. 3) to matingly receive a corresponding collar 85 (as shown in FIGS. 2 and 3) that may be integrally formed with drive shaft 80.

Outlet vanes annulus 50 is made of Delrin or other lightweight, strong, heat insulative material, and includes a plurality of individual outlet vanes 51 along its perimeter (one for each radial compartment 45), a cylindrical sleeve 52, and an annulus portion 53 integrally formed with outlet vanes 51 and sleeve 52. As best illustrated in FIG. 1, the outer and inner radii of outlet vanes annulus 50, and its height (that is, its dimension from front to back) are sized such that outlet vanes annulus 50 is received snugly within impeller 40 and acts to substantially close radial compartments 45 to fluid flow except for an axial fluid inlet 89 to each radial compartment 45 near drive shaft 80, and a fluid outlet 56 to each radial compartment 45 at the perimeter of outlet vanes annulus 50.

Inlet vanes disk 60 is made of Delrin or other lightweight, strong, heat insulative material, and includes a plurality of individual inlet vanes 61 (one for each radial compartment 45) emanating from a hub 62 integrally formed therewith. The radius of inlet vanes disk 60 to its perimeter, and its height (that is, its dimension from front to back) are sized such that inlet vanes disk 60 is received snugly within cylindrical sleeve 52 and acts to receive the working medium (air), and direct the same into radial compartment 45 near drive shaft 80.

Shroud 70 is made of Delrin or other lightweight, strong, heat insulative material, and includes a closure ring 71 and a shroud annulus 72 that may be made integrally therewith. Closure ring 71 has an outer diameter that engages the outside of the open end of housing 20 by interference fit, and a reduced inner diameter. The upper portion of radial spacing ribs 73 extend from the inner diameter of closure ring 71 to the outer edge of shroud annulus 72, thereby integrally carrying the latter and defining a restricted nozzle 74 for the output from outlet vanes 51. The inner diameter of shroud annulus 72 should substantially equal that of the outer diameter of cylindrical sleeve 52, defining a cylindrical channel 76 for the input to inlet vanes 61. Thus, shroud 70 insures that outlet vanes annulus 50 remains securely within impeller 40 and provides a nozzle from outlet vanes 51 and an input channel into inlet vanes 61. Shroud annulus 72 may be formed as a solid or, as shown in FIGS. 1–3, to reduce weight with substantially equal structural integrity, may be formed with the lower portion of ribs 73 extending radially inwardly from the outer diameter of shroud annulus 72 to its inner diameter, and at least a portion of shroud annulus 72 extending radially between its inner and outer diameters and circumferentially between ribs 73 removed.

Air flow through device 10 is most effectively seen in FIG. 3 where it is pictorially represented by multiple lines with arrowheads. Air in the vicinity of cylindrical channel 76 is smoothly drawn therethrough by inlet vanes 61 and directed into the radially innermost portion of radial compartments 45. Once inside compartments 45, the rotation of radial blades 44 (as shown in FIG. 1 and FIG. 2) impart centrifugal energy from drive shaft 80 to the air, effecting a compression of the air within radial compartments 45, and producing a pressure, temperature and density increase within radial compartment 45. In this manner, the centrifugal force is applied to and compresses the working medium (air) and its entropy decreases during this discrete step of compression.

The compressed air is then allowed to expand as it exits the radially outwardmost portion of radial compartments 45 through outlet vanes 51 and nozzle 74. The expansion must proceed with a change in entropy between zero and no greater than the magnitude of the decrease in entropy accomplished during compression. This may be realized by configuring outlet vanes 51 to insure that as the compressed air is allowed to expand, its potential energy is simultaneously converted to kinetic energy and a component of the thrust produced by the ejection of the working medium (air) is converted to torque at drive shaft 80, and more preferably the velocity of outlet vanes 51 is substantially equal to the tangential component of the working medium ejection velocity.

Two acceptable configurations of outlet vanes 51 that achieve expansion in the necessary manner may be best viewed in the enlargements of FIGS. 4–7, on one hand, and 8–11 on the other. In FIGS. 4–7 (and particularly FIG. 7) a first configuration of outlet vanes 51, illustrated in the inset shown in FIG. 3, may be seen to possess vane thicknesses that are substantially constant but have vane root diameters that vary from smallest at their inlet 55 to largest at their outlet 56. In FIGS. 8–11 (and particularly FIG. 11), a second configuration of outlet vanes 51, illustrated in the inset shown in FIG. 3, may be seen to possess vane root diameters that remain substantially constant but have vane thicknesses that vary from smallest at their inlet 55 to largest at their outlet 56. The passageway between the inlet 55 and the outlet 56 forms a venturi. The ratio of the area of inlet 55 to the area of the outlet 56 determines the extent of conversion of potential energy of the working medium to kinetic energy, and is preferably chosen to convert all the potential energy increase resulting from compression of the working medium (air) at inlet 55 to kinetic energy in the form of the ejection velocity of the working medium (air) at outlet 56.

When the working medium in this radial compartment 45 is allowed to exit and expand, the pressure decreases. During this step, the temperature of the working medium also deceases to a value below the temperature of the air when drawn into device 10, thereby creating a thermal difference. The relatively cool working medium is then transferred to a region being cooled by means understood by those skilled in the art.

The preferred embodiment contemplates variation of potential energy in the working medium by displacement of less than all the components of the units of the working medium or its energy levels. The skilled artisan should now appreciate that the concept of the present invention may be realized with force applied in any manner that does not uniformly alter the entropy of the working medium.

Inasmuch as the present invention is subject to variations, modifications and changes in detail, some of which have been expressly stated herein, it is intended that all matter described throughout this entire specification or shown in the accompanying drawings be interpreted as illustrative and not in a limiting sense. It should thus be evident that a device constructed according to the concept of the present invention, and reasonably equivalent thereto, will accomplish the objects of the present invention and otherwise substantially improve the art of thermal transfer devices and methods therefor.

I claim:

1. A method for generating a thermal difference in a working medium between an inlet and an outlet of an enclosure and transferring the thermal difference to a region being cooled, comprising the steps of:

drawing the working medium into the enclosure through the inlet;

applying a force to compress the working medium in the enclosure with decreasing entropy in the working medium and with an input of work to the working medium;

allowing the working medium to expand through the outlet with a change in entropy between zero and no greater than the magnitude of the decrease in entropy during the step of compression and with an output of work from the working medium equal to or greater than the work input to the working medium in the step of compression thereby causing a thermal difference in the working medium between the inlet and the outlet and, transferring the thermal difference to the region being cooled.

2. A method, as set forth in claim 1, wherein said step of applying a force includes the step of applying at least one acceleration force selected from the group including gravitation, centrifugal, centripetal, electromagnetic, electric and magnetic.

3. A method, as set forth in claim 2, wherein the working medium exists in a plurality of dimensions and said step of applying an acceleration force includes the step of applying an acceleration force in less than the plurality of dimensions in which the working medium exists.

4. A method, as set forth in claim 3, wherein said step of applying an acceleration force in less than the plurality of dimensions in which the working medium exists includes the step of imparting a change in potential energy of the working medium in less than the plurality of dimensions in which the working medium exists.

5. A method, as set forth in claim 2, wherein said step of applying a force to compress the working medium includes the step of applying a force to compress a fluid having no fluorinated hydrocarbons.

6. A method, as set forth in claim 5, wherein said step of applying a force to compress a fluid having no fluorinated hydrocarbons includes the step of applying a force to compress air.

7. A method, as set forth in claim 1, wherein said step of applying a force includes the step of decreasing the disorder of selected portions of the working medium.

8. A method, as set forth in claim 1, wherein said step of applying a force includes the step of rotating the enclosure, and the step of allowing the working medium to expand includes the step of increasing the torque on the rotating enclosure by ejecting the working medium from the enclosure.

9. A method, as set forth in claim 1, wherein the working medium is a fluid, said step of applying a force includes the step of rotating the enclosure about a center of rotation, and the step of allowing the working medium to expand includes the step of allowing a phase change in said fluid and increasing the torque on the rotating enclosure by returning said phase changed fluid to said center of rotation.

10. A method, as set forth in claim 1, wherein said step of allowing the working medium to expand includes the step of converting the potential energy associated with the working medium due to compression to work.

11. A method for cooling a cooling region comprising the steps of:

providing a working medium at temperature $T_1$;

accelerating the working medium with decreasing entropy in the working medium and with an input of work to the working medium, where the temperature of the working medium is equal to or greater than $T_1$;

ceasing the acceleration of the working medium;

expanding the working medium into an expansion region with a change in entropy between zero and no greater than the magnitude of the decrease in entropy during the step of compression and with an output of work from the working medium equal to or greater than the work input to the working medium in the step of compression, where the temperature of the working medium changes to $T_2$ which is lower than $T_1$; and, cooling the cooling region using the working medium at temperature $T_2$.

* * * * *

UNITED STATES PATENT AND TRADEMARK OFFICE

CERTIFICATE OF CORRECTION

PATENT NO. : 5,765,387

DATED : June 16, 1998

INVENTOR(S) : Amin

It is certified that error appears in the above-identified patent and that said Letters Patent is hereby corrected as shown below:

On the title page, Item [54], and Column 1,

In the Title, please delete "DEVICE AND ".

Col. 8, line 50,

In the Claims, please add the following new claims 12-20:

12. A method as set forth in claim 11 wherein said step of accelerating includes the step of applying at least one acceleration force selected from the group including gravitation, centrifugal, centripetal, electromagnetic, electric and magnetic.

13. A method as set forth in claim 12 wherein the working medium exists in a plurality of dimensions and said step of applying an acceleration force includes the step of applying an acceleration force in less than the plurality of dimensions in which the working medium exists.

14. A method as set forth in claim 13 wherein said step of applying an acceleration force in less than the plurality of dimensions in which the working medium exists includes the step of imparting a change in potential energy of the working medium in less than the plurality of dimensions in which the working medium exists.

15. A method as set forth in claim 12 wherein said step of applying an acceleration force includes the step of applying a force to compress a fluid having no fluorinated hydrocarbons.

16. A method as set forth in claim 15 wherein said step of applying an acceleration force to compress a fluid having no fluorinated hydrocarbons includes the step of applying a force to compress air.

17. A method as set forth in claim 11 wherein said step of accelerating includes the step of decreasing the disorder of selected portions of the working medium.

18. A method as set forth in claim 11 wherein said step of accelerating includes the step of rotating the working medium and wherein the step of expanding the working medium includes the step of expanding the working medium in a direction which increases the torque on the rotating working medium.

UNITED STATES PATENT AND TRADEMARK OFFICE

CERTIFICATE OF CORRECTION

PATENT NO. : 5,765,387

DATED : June 16, 1998

INVENTOR(S) : Amin

It is certified that error appears in the above-identified patent and that said Letters Patent is hereby corrected as shown below:

19. A method as set forth in claim 11 wherein the working medium is a fluid, wherein said step of accelerating includes the step of rotating the working medium about a center of rotation, and wherein the step of expanding the working medium includes the step of allowing a phase change in said fluid and increasing the torque on the rotating working medium by returning said phase changed fluid to said center of rotation.

20. A method as set forth in claim 11 wherein said step of expanding the working medium includes the step of converting potential energy associated with the working medium due to acceleration to work.

Signed and Sealed this

Twentieth Day of July, 1999

*Attest:*

*Attesting Officer*

Q. TODD DICKINSON

*Acting Commissioner of Patents and Trademarks*